United States Patent [19]

Farrell

[11] 4,146,334

[45] Mar. 27, 1979

[54] PAINT MIXING AND DISPENSING APPARATUS

[76] Inventor: Richard Farrell, 713 Willis Ave., Williston Park, N.Y. 11596

[21] Appl. No.: 831,807

[22] Filed: Sep. 9, 1977

[51] Int. Cl.[2] ..... B65D 61/32

[52] U.S. Cl. ..... 366/192; 222/229; 222/235; 222/242; 222/525; 366/194; 366/250; 366/605

[58] Field of Search ..... 366/192, 193, 194, 195, 366/261, 314, DIG. 605, 250; 222/229, 235, 242, 525

[56] References Cited

U.S. PATENT DOCUMENTS

| | | | |
|---|---|---|---|
| 2,180,468 | 11/1939 | Hochstien | 222/229 |
| 2,851,257 | 9/1958 | Morgan | 366/195 |
| 3,005,624 | 10/1961 | Hoppe et al. | 366/195 |
| 3,402,918 | 9/1968 | Soulier | 366/194 |
| 3,583,682 | 6/1971 | Berents | 366/194 |

*Primary Examiner*—David A. Scherbel
*Attorney, Agent, or Firm*—James & Franklin

[57] ABSTRACT

The pneumatically operated apparatus includes a transparent, calibrated paint container to facilitate measuring of the required proportions of color and solvents. A vertically displaceable and rotatable member extends through and seals an opening in the bottom of the container. The member has a hollow body forming a paint passage. An agitator is sealingly mounted on the end thereof extending through the opening and into the container, the other end being opened. An aperture is provided in the wall of the member spaced a short distance from the agitator. A friction surface is provided for connecting a pneumatically operated drive to the member to rotate same. The member is vertically displaceable between a mixing position, wherein the friction surface is effective to engage the member and rotate same and the aperture is situated below the container seal to prevent paint flow and a dispensing position, wherein the friction surface is disengaged from the member and the aperture is at least partially situated above the seal in the container, so as to provide a passage to permit gravity to cause the paint to flow through the body and out the bottom opened end thereof.

10 Claims, 5 Drawing Figures

PAINT MIXING AND DISPENSING APPARATUS

The present invention relates to paint mixing and dispensing apparatus and more particularly to a pneumatically operated, gravity feed paint mixer and dispenser.

Automotive body shops, marinas and like concerns which paint boats of automotive vehicles are required to mix the paint utilized to obtain the necessary color. Due to the nature of the metallic and other pigmentation in the paint, continuous agitation or mixing of the paint composition is required, throughout the painting process, to insure uniform metallic and color pigmentation and eliminate the coagulated sediment of metallics and pigmentation on the bottom of the can. If the paint mixture is not continuously agitated, color variations occur because it is not a uniform mixture. To date, it has been necessary to strain the mixture prior to painting, to eliminate the coagulated pigmentation. In doing this the color is altered because of improper agitation.

Such automotive painting facilities are normally equipped with an air compressor. The compressor is used in the actual painting of the vehicle and powers other pneumatically operated devices. This being the case, it is advantageous to utilize this source of compressed air in order to perform the paint agitation, instead of providing relatively expensive electric motors to provide this function, which require maintenance and space, and must be protected from evaporating paint solvents to avoid explosion.

It is, therefore, a prime object of the present invention to provide apparatus for mixing and dispensing paint which utilizes a pneumatically operated agitation system to continuously mix the paint composition so as to insure uniform color and eliminate coagulation of pigment and metallics, such that straining is not required.

It is a further object of the present invention to provide apparatus for mixing and dispensing paint which utilizes a gravity feed dispensing system.

It is a further object of the present invention to provide apparatus for mixing and dispensing paint which comprises a self-supporting stand and wall mount so as to leave the operator's hands free.

It is still another object of the present invention to provide apparatus for mixing and dispensing paint which utilizes a transparent calibrated paint container in order to facilitate measuring of the correct proportions of the various colors and solvents in accordance with manufacturer's recommendations to insure the color match and eliminate a major portion of wasted materials.

It is a still further object of the present invention to provide an apparatus for mixing and dispensing paint which is self-cleaning and which comprises relatively simple inexpensive parts which function together in a reliable and maintenance free manner.

In accordance with the present invention, the apparatus for mixing and dispensing paint includes a transparent, calibrated container and an elongated member extending through and sealing an opening in the bottom of the container. The elongated member has a hollow body with an opened bottom end, agitation means sealingly mounted on the top end thereof which extends into the container beyond the seal and an aperture in the wall thereof so as to form a paint passage through the body. A friction means connects a pneumatically operated drive to the elongated member for rotating same, and thus the agitation means, to mix the paint. Means are provided for moving the elongated member between a mixing position, wherein the friction means engages the member and rotates same and the aperture is situated below the seal and thus outside the container and a dispensing position, wherein the friction means is disengaged from the elongated member and the aperture is at least partially situated above the seal and thus within the container, so as to permit gravity to cause the paint to flow through the body and out the opened bottom end thereof.

The drive means includes a fan member and means for directing a source of air to drive the fan member. The friction means comprises a collar member, operably connected to the fan member and rotatable therewith, adopted to frictionally engage the elongated member when the elongated member is in the mixing position. The elongated member is preferably provided with a tapered surface which is frictionally engaged by a correspondingly tapered surface on the collar member so as to rotate elongated member, and thus the agitation means, when the elongated member is in the mixing position.

Spring means are provided for urging the elongated member towards the mixing position. The spring means also acts to maintain the frictional engagement between the correspondingly tapered surfaces on the elongated member and the collar member, when the elongated member is in the mixing position.

An enclosure is provided to house the elongated member, the collar member, the pneumatically operated drive means and the spring means. The moving means, preferably in the form of a manually actuated handle, is pivotally connected at one end thereof to the enclosure. The moving means is provided with a pair of upwardly extending protrusions, which are designed to operatively engage a bearing connected to the elongated member to move the latter between the mixing position and the dispensing position. The handle member is movable between first and second positions, to move the member between mixing and dispensing positions, respectively.

The agitation means includes a base member, which is sealingly mounted to the open top end of the body. Mounted on the base member is a pair of propeller-like protrusions which, when the elongated member is rotated, serve to agitate the paint in the container.

dr

To the accomplishment of the above and to such other objects as may hereinafter appear, the present invention relates to an apparatus for mixing and dispensing paint as recited in the annexed claims and described in detail in the present specification, taken together with the accompanying drawings wherein like numerals refer to like parts and in which:

Figure 1:
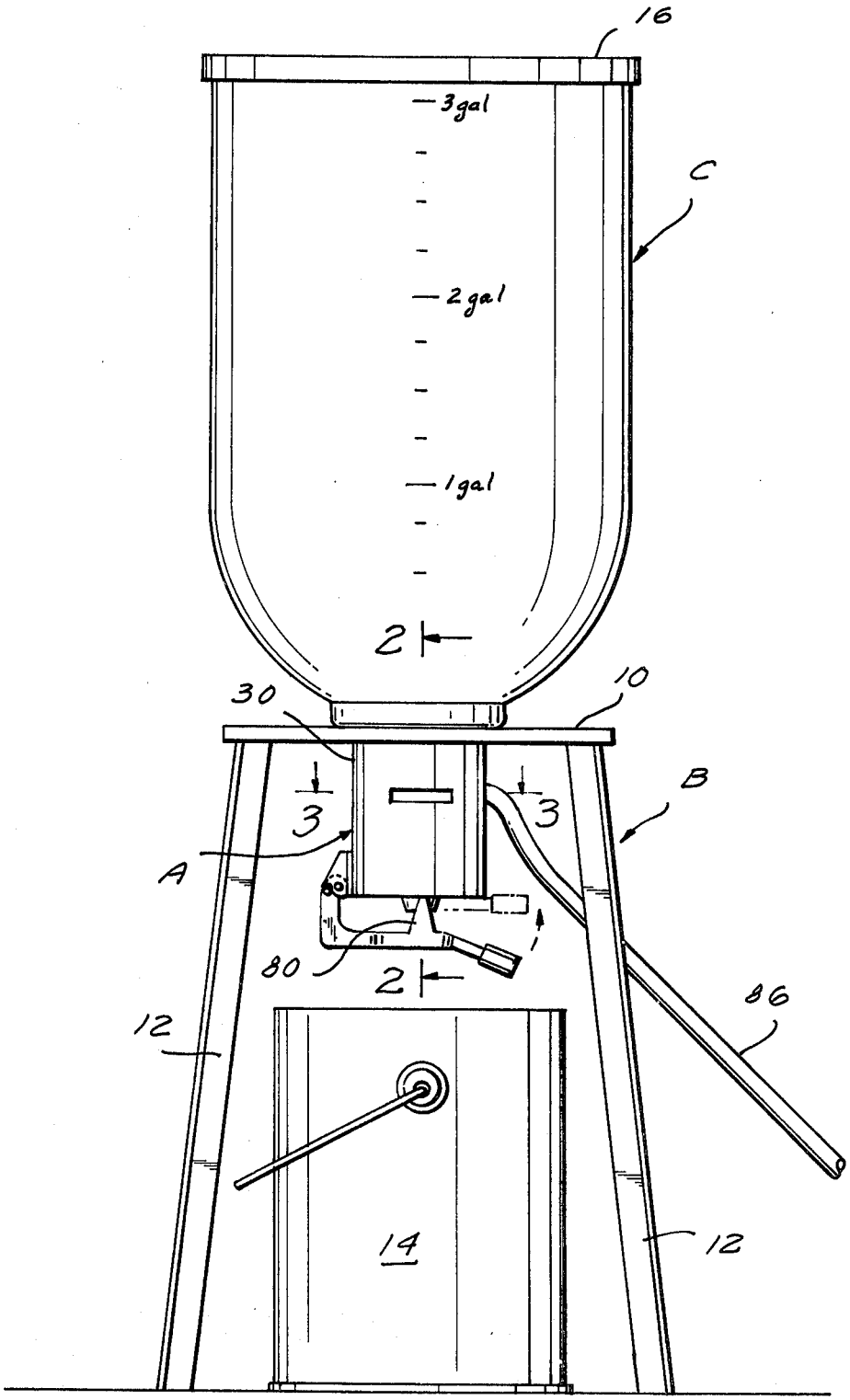
FIG. 1 is an environmental view of the apparatus for mixing and dispensing paint of the present invention.

As seen in FIG. 1 the apparatus for mixing and dispensing paint, generally designated A, is mounted on a support, generally designated B, and includes a transparent, calibrated paint reservoir or container, generally designated C. Support B includes a generally planer support surface 10, having an aperture therein through which the mixing and dispensing apparatus A extends so as to permit the bottom of container C to be affixed thereto. Surface 10 is supported by a plurality of legs 12 such that a bucket or other receptacle 14 can be inserted beneath apparatus A to receive the dispensed paint.

Container C is provided with a removable cover 16 at the top thereof so as to permit the various paint constituents to be poured therein. The calibrations on the side of container C facilitate the accurate formulation of the paint and solvents by providing a readily visible guide to enable the operator to measure the required proportions of paint constituents. Container C is preferably interchangeable with other containers of different sizes and having different calibrations, such that smaller or larger quantities of paint may be mixed and dispensed.

Figure 2:
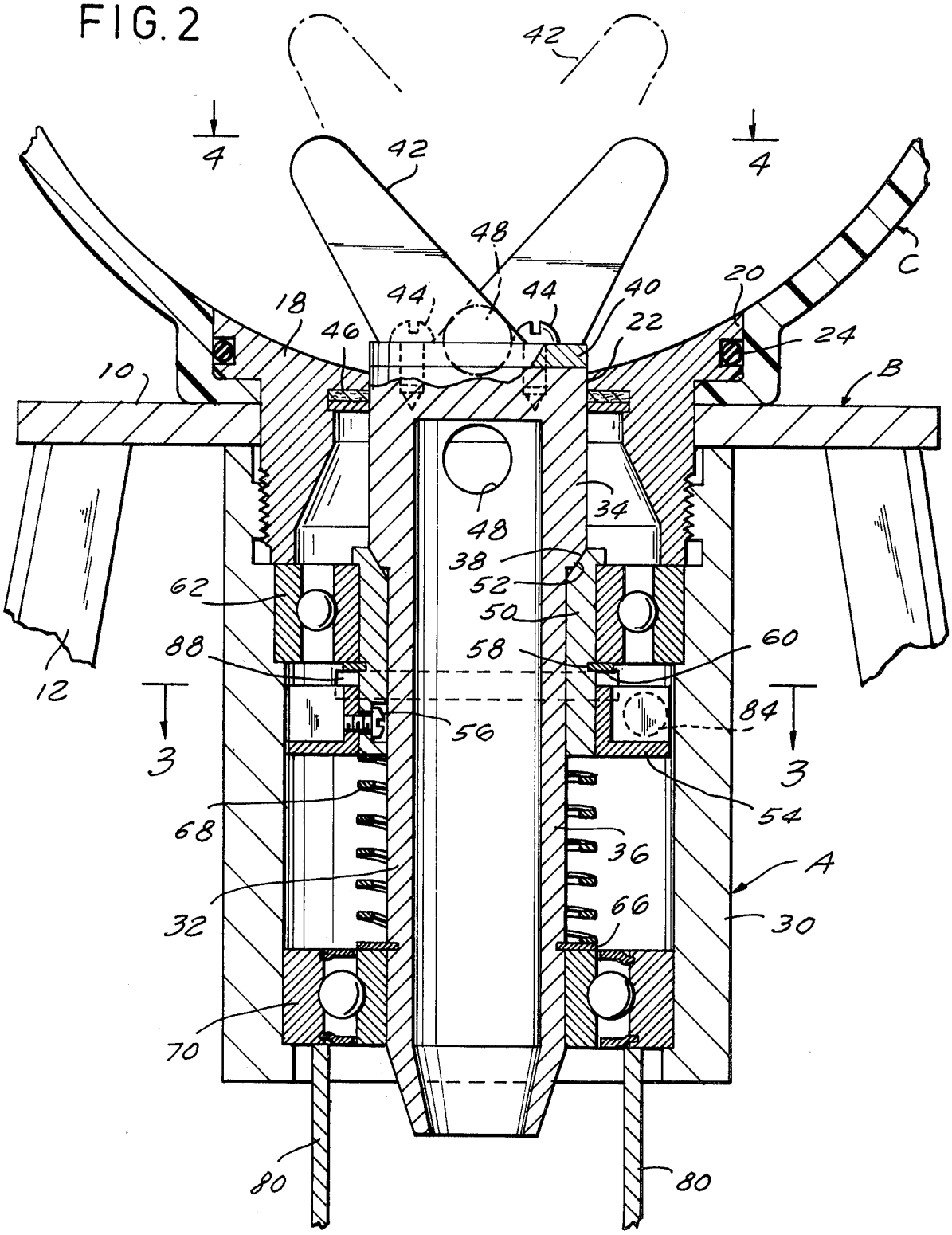
FIG. 2 is a cross-sectional view taken along line 2—2 showing the assembled parts of the apparatus for mixing and dispensing paint of the present invention.
Figure 5:
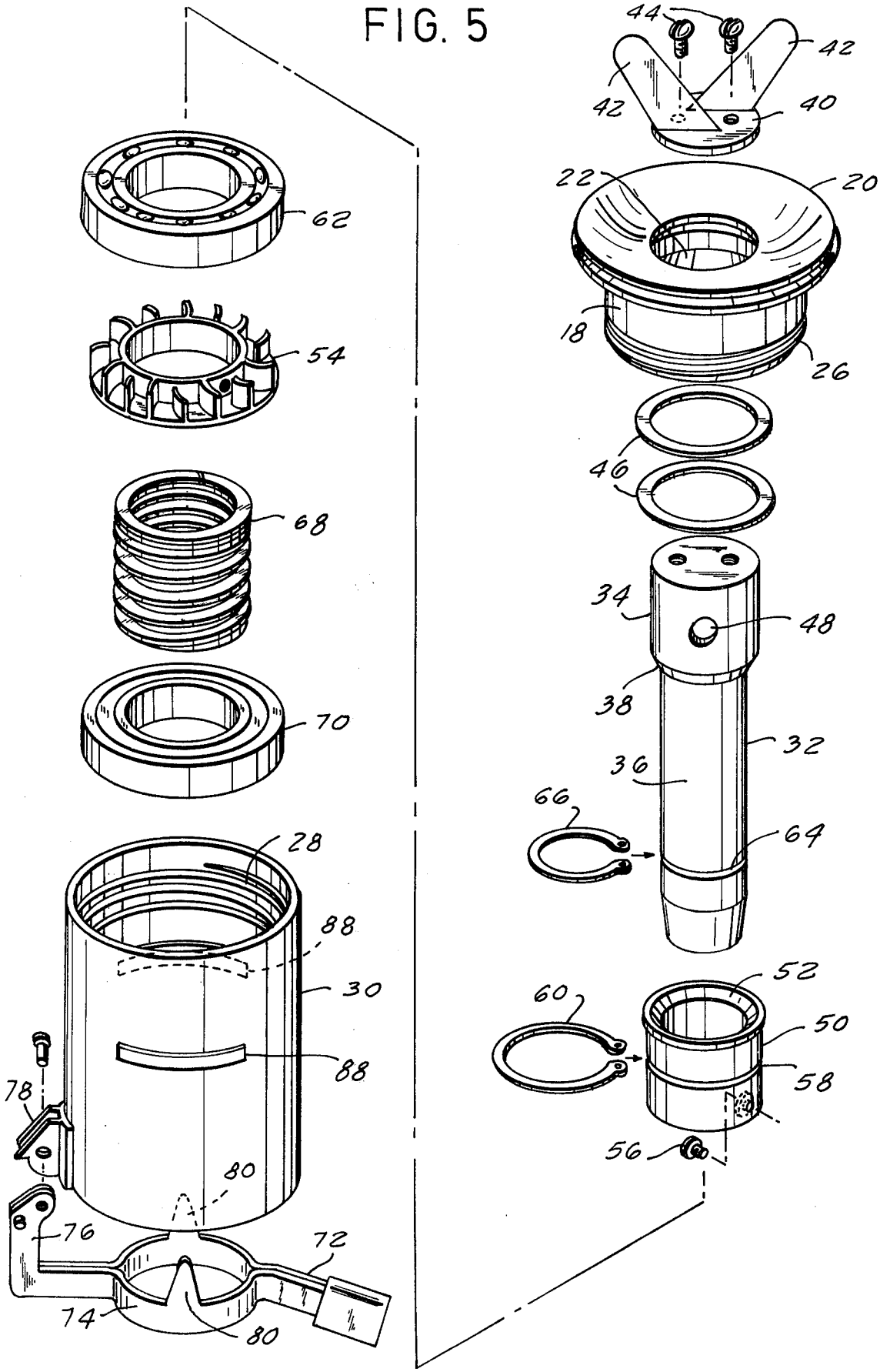
FIG. 5 is an exploded isometric view of the apparatus for mixing and dispensing paint of the present invention.

As best illustrated in FIGS. 2 and 5, the opened bottom of container C has inserted therein an annular sealing member 18 having an upper flanged portion 20, the interior of which is tapered towards a central opening 22. A sealing ring 24 is provided around the periphery of flanged portion 20 so as to seal same to the neck of container C. The lower circular portion of member 18 is provided with external threads 26, which mate with the internal threads 28 of an enclosure 30. Enclosure 30 is a generally cylindrical, hollow, open ended body, within which the remainder of the apparatus is situated.

Located within enclosure 30, but extending beyond the ends thereof, is a elongated member 32 the upper portion of which is proportioned to sealingly engage opening 22 in sealing member 18. Member 32 comprises a hollow body having a first portion 34 and a second portion 36. The circumference of portion 34 on member 32 is somewhat larger than the circumference of portion 36 of member 32. Portions 34 and 36 are connected by an inwardly tapering surface 38, the purpose of which is described below. The top surface of body 32 is closed so as to provide a support for the agaitation means, which comprises a disc-like base 40 and a pair of protruding veins or propeller blades 42. Base 40 is mounted to the top surface of member 32 by any conventional means, such as screws 44.

The outer diameter of portion 34 of member 32 is selected to be approximately equal to the inner diameter of opening 22 in sealing means 18. A pair of O rings 46 are situated in a circular groove or channel within member 18 so as to sealingly engage the outer surface of portion 34 of member 32, such that the paint from container C cannot pass between outer wall of member 32 and the inner wall of sealing means 18.

The bottom end of member 32 is opened and has a slight inward taper. The side walls of portion 34 are provided with a pair of oppositely oriented apertures 48 which, because member 32 is hollow, are connected to the opened bottom end of member 32 to provide a passage for paint through member 32, when aperture 48 is situated above the top of sealing member 18 and thus within container C.

As illustrated in FIG. 2, apertures 48 are normally situated below sealing rings 46 and therefore not in a position where paint from container C can enter therein. However, as explained in detail below, member 32 is vertically displaceable relative to sealing member 18, between a mixing position, (shown in FIG. 2) wherein apertures 48 are below sealing rings 46 thereby preventing paint from passing through member 32 and a dispensing position (indicated in phantom in FIG. 2) wherein apertures 48 are at least partially situated above the top surface of sealing member 18 such that paint from container C can flow through apertures 48, along the passage within member 32, and out the bottom open end thereof, to provide gravity feeding of the paint from the bottom of the enclosure 30.

A collar member 50 is provided to frictionally engage member 32. Member 50 has a central aperture into which portion 36 of member 32 is inserted. The top of collar member 50 has a surface 52, which is preferably tapered at an angle corresponding to tapered surface 38 on member 32. A fan member 54 is fixedly mounted to collar member 50 by any appropriate means, such as screw 56. As fan member 54 is pneumatically driven, collar 50 is rotated. When member 32 is in the mixing position (shown in FIG. 2), tapered surface 38 thereon is frictionally engaged by correspondingly tapered surface 52 on member 50, so as to rotate member 32 and thus the mixing blades 42. Member 32 is movable in a vertical direction with respect to collar member 50 so as to disengage the friction means.

The outer surface of collar 50 is provided with an angular groove 58 in which a retaining ring 60 is partially situated. An angular bearing member 62 has its inner race inserted between retaining ring 60 and the outwardly extending lip of the upper flanged portion of collar member 50. The outer race of bearing 62 is fixed to the interior wall of enclosure 30 immediately below threads 28. In this manner, collar member 50 is freely rotatable with respect to enclosure 30.

Portion 36 of member 32 is provided with an angular groove 64 in which a second retaining ring 66 is partially situated. A tension spring 68 is inserted between retaining ring 66 and the bottom of collar member 50. Spring 68 surrounds portion 36 of member 32 and rotates therewith. Spring 68 maintains member 32 in the mixing position, as shown in FIG. 2, and in addition, urges tapered surface 38 of member 32 into frictional engagement with correspondingly tapered surface 52 of collar member 50, so as to maintain the frictional connection between collar member 50 and member 32 when member 32 is in the mixing position.

A second bearing member 70, situated within enclosure 30, has its outer race resting on the inwardly extending bottom lip of enclosure 30. However, the outer race of bearing 70 is not fixedly connected to the inner wall of enclosure 30 and in fact is vertically movable with respect thereto towards container C. As bearing member 70 is moved upwardly, the inner race thereof pushes against retaining ring 66 of member 32 causing member 32 to move upwardly to the dispensing position. The upward movement of member 32 further compresses spring 68 and disengages friction connection between collar member 50 and member 32.

The movement of bearing member 70, with respect to enclosure 30, is achieved by means of handle member 72. Handle member 72 is provided with a ring-like portion 74 to permit paint from member 32 to flow therethrough and a connecting arm 76 which is pivotally mounted to the side of enclosure 30 by means of a bracket 78. Ring-like portion 74 of handle member 72 is provided with a pair of upwardly extending protrusions 80 which, when handle member 72 is moved upwardly, engage the outer race of bearing 70 to move same upwardly within enclosure 30 and therefore to move member 32 towards the dispensing position.

Figure 3:
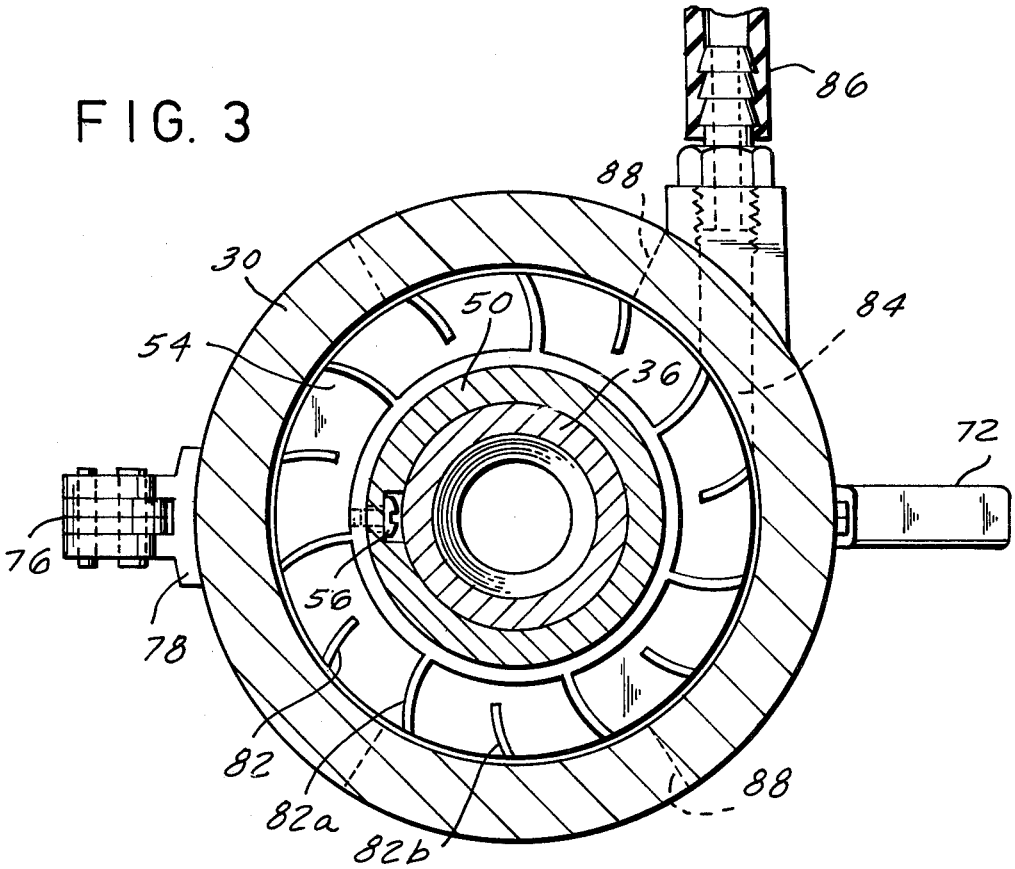
FIG. 3 is a cross-sectional view taken along line 3—3 of FIG. 1.

FIG. 3 shows a plan view of fan member 54. Fan member 54 comprises a plurality of fan blades 82. Fan member 54 is rotatable in a plane which is adjacent to an air passage 84 in enclosure 30. Passage 84 is connected to a hose 86. Hose 86 is connected to source of compressed air, such that the air is directed in a path generally perpendicular to blades 82 to rotate fan member 54. Slots 88 on either side of enclosure 30 are provided to permit the exiting of the spent air, after same has rotated member 54.

As illustrated in FIG. 3, blades 82 are of two different structures, some of which (82*a*) extend all the way from the periphery of member 54 to the inner upstanding circular wall thereof and some of which (82*b*) extend only partially from the outer periphery to the inner wall. Blades 82*a* and 82*b* are alternately situated around member 54. Blades of this design permit more efficient use of the compressed air as same is feed through aperture 84 in enclosure 30. The air engages the blades 82*b* passes between the ends of these blades and the inner wall and then subsequently engages the adjacent blade 82*a*, such that the compressed air is utilized twice to rotate fan member 54.

Figure 4:
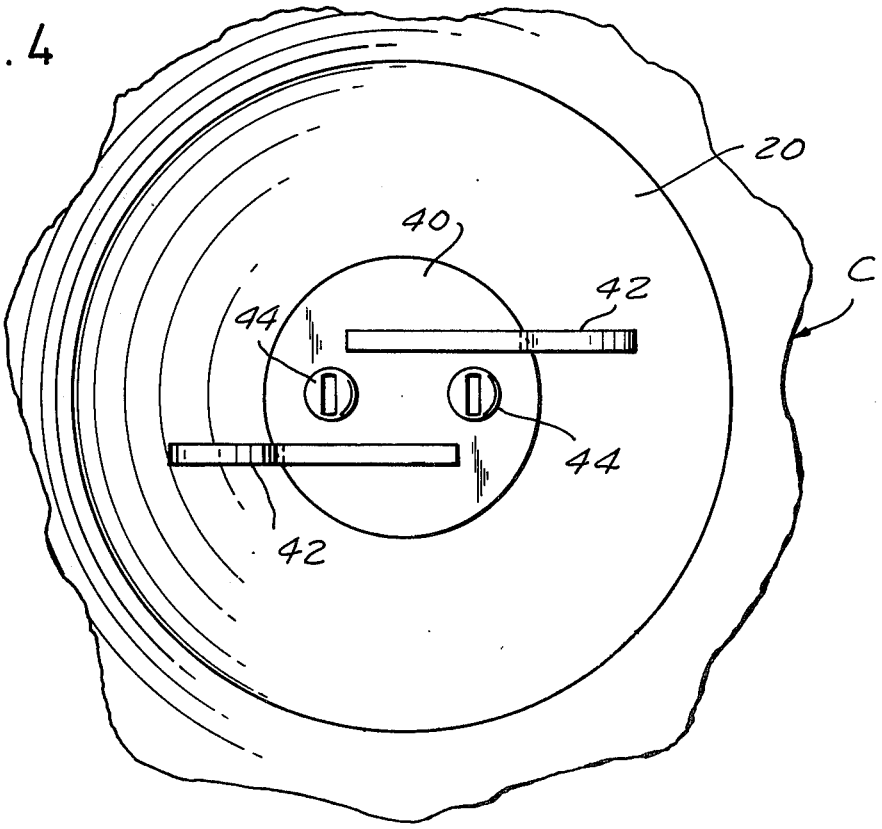
FIG. 4 is a plan view of the apparatus for mixing and dispensing paint of the present invention, taken along line 4—4 of FIG. 2.

A top view of the agitation means is shown in FIG. 4. In this figure it can be seen that the upwardly projecting blades 42 extend outwardly of base portion 40, so as to provide an adequate mixing surface to assure complete agitation of the paint within container C as the agitation means is rotated along with member 32.

In the mixing position, compressed air is fed through passage 84 in enclosure 30 and serves to rotate fan member 54. The rotation of fan member 54 in turn rotates collar member 50 which frictionally engages member 32 by means of correspondingly tapered surfaces 38 and 52. The rotation of member 32 causes rotation of the agitation means thereby causing blades 42 to continuously mix the paint within container C. In this position, apertures 48 in portion 34 of member 32 are below sealing rings 46 and thus no paint passes into the passage within member 32.

When handle member 72 is lifted, upwardly extending protrusions 80 on ring-like member 74 engage the outer race of bearing 70, which is likewise moved upwardly within enclosure 30. The upward movement of bearing 70 moves member 32 upwardly to the dispensing position. This movement of member 32 further compresses spring 68 and disengages collar member 50 from member 32 to terminate the rotation thereof. In the dispensing position, apertures 48 are at least partially situated above sealing rings 46 such that paint from container C can flow therethrough. The paint, after it enters apertures 48, moves downwardly within hollow member 32, by means of gravity, and out the lower open end thereof into receptacle 14. Releasing handle member 72 permits spring 68 to move member 32 towards the mixing position, wherein collar member 50 once again engages member 32 and the rotation thereof is again commenced.

In order to clean the apparatus, paint thinner is poured into container C, the agitator is activated and the member 32 is then moved to the dispensing position, such that the paint thinner is fed, by means of gravity, through the apparatus to clean same. After the apparatus is cleaned it is ready to mix a new batch of paint.

As can be readily appreciated, the present invention relates to a pneumatically operated paint mixing and dispensing apparatus which facilitates the formulation of the mixture, continuously agitates same to eliminate the need for straining and insure uniform color which permits gravity dispensing of the mixture as desired. The apparatus utilizes a friction connection between the drive and the agitation means to permit easy disconnection during dispensing. It is formed of a few relatively simple parts which operate together in a reliable manner.

While only a single preferred embodiment of the present invention has been disclosed herein, it is obvious that many modifications and variations can be made thereto. It is intended to cover all of these modifications and variations which are within the scope of the present invention as defined by the following claims:

I claim:

1. Apparatus for mixing and dispensing paint comprising a container having an opening; a member extending through said opening in the bottom of the container, said member comprising a hollow body formed by a wall and having an opened end and a closed end; sealing means between said opening and said member; agitation means sealingly mounted on the closed end thereof and an aperture in said wall thereof; drive means; friction means for operably connecting said drive means to said member; and means for moving said member between a mixing position, wherein said friction means operably connects said drive means to said member and said aperture is below said sealing means and thus situated outside said container, and a dispensing position, wherein said drive means is disengaged from said member and said aperture is at least partially situated above said sealing means and thus within said container, so as to permit paint to flow through said member and out the opened end thereof.

2. The apparatus of claim 1 wherein said drive means comprises a fan, means for directing an air stream to drive said fan, and said friction means comprises means operably connected to said fan to rotate therewith, said rotating means frictionally engaging said member when said member is in said mixing position.

3. The apparatus of claim 2 wherein said member has a tapered surface therein and said rotating means has a correspondingly tapered surface adopted to frictionally engage said surface on said member.

4. The apparatus of claim 3 further comprising spring means for urging said member towards said mixing position.

5. The apparatus of claim 4 wherein said spring means maintains frictional engagement between said tapered surfaces on said member and said rotating means, when said body is in said mixing position.

6. The apparatus of claim 1 further comprising spring means for urging said member towards said mixing position.

7. The apparatus of claim 1 further comprising an enclosure through which said member extends, said enclosure being mounted over the opening in said container.

8. The apparatus of claim 7 wherein said moving means comprises a handle member, means for pivotally mounting said handle member to said enclosure said handle member having means thereon operatively engaging said member and adapted to move same between said mixing and said dispensing positions as said handle member is moved between first and second positions, respectively.

9. The apparatus of claim 1 wherein said agitation means comprises a base member mounted on said closed end of said member and a blade extending from said base such that said paint is mixed as said member is rotated.

10. Apparatus for mixing and dispensing paint comprising a hollow open ended enclosure; a member extending through said enclosure and having a passage therein; means for closing said passage; agitation means mounted on said member at a point outside said enclosure; means for rotating said member; and means for moving said member relative to said enclosure between a mixing position, wherein said closing means closes said passage and said rotating means engages said member, and a dispensing position, wherein said passage is at least partially opened and said rotating means is disengaged from said member.

* * * * *